United States Patent [19]

Stowell

[11] Patent Number: 4,777,871

[45] Date of Patent: Oct. 18, 1988

[54] CHIMNEY TILE ADAPTER PLATE

[75] Inventor: David L. Stowell, Boise, Id.

[73] Assignee: Artis Metals Co., Inc., Boise, Id.

[21] Appl. No.: 108,548

[22] Filed: Oct. 13, 1987

[51] Int. Cl.[4] ..... E04H 12/28

[52] U.S. Cl. ..... 98/67; 52/244; 52/218

[58] Field of Search ..... 52/218, 219; 285/172, 285/64; 98/58, 59, 60, 61, 67

[56] References Cited

U.S. PATENT DOCUMENTS

| | | | |
|---|---|---|---|
| 687,907 | 12/1901 | Streby | 98/60 |
| 1,302,328 | 4/1919 | Donald | 98/67 |
| 1,362,947 | 12/1920 | Legg | 52/219 |
| 1,632,871 | 6/1927 | Beach | 98/60 |
| 2,300,088 | 10/1942 | Artis | 98/58 |
| 2,381,178 | 8/1945 | Munyon | 98/58 |
| 2,537,235 | 6/1951 | Steelman | 98/67 |

*Primary Examiner*—Henry E. Raduazo
*Attorney, Agent, or Firm*—Paul F. Horton

[57] ABSTRACT

A chimney tile adapter plate for securing a chimney cap, chimney flue, spark arrester, or other chimney extension member to existing chimney tile. The tile adapter plate of the present invention includes a deflector plate, with flue opening, which rests upon the top edge or lip of the chimney tile; a collar surrounding the opening and upwardly extending from the deflector plate for attachment of the chimney extension member; a flexible, elongated band secured to the undersurface of the deflector plate, preferably by slotted brackets; and a hose-type adjustable clamp engaging both ends of the band for tightening and clamping the band about the chimney tile. The band, in being flexible, is usable on chimney tile of varying shapes and, in combination with the adjustable clamp, is usable on chimney tiles of varying circumference.

7 Claims, 1 Drawing Sheet

CHIMNEY TILE ADAPTER PLATE

BACKGROUND OF THE INVENTION

1. Field of the Invention

This invention relates to adapters for connecting chimney caps, spark arresters, flue extensions, and other chimney extension members to existing chimney tile.

2. Description of the Prior Art

Currently, chimney extensions are made to substantially conform to the shape of the chimney liner or chimney tile so that they may be attached directly thereto. In that, even with substantial conformity, chimney tile may be of slightly different exterior dimensions, and in that it is highly desirable that the chimney extension be securely fastened to the liner or tile, efforts have been made to achieve this end. Typical of these inventions is the chimney liner extension of L. H. Munyon, U.S. Pat. No. 2,381,178. Munyon provides an extension which is provided with a slip joint and an adjustable clamp for pulling the walls of the extension member together or forcing them apart for tight frictional engagement with the walls of the liner.

Neither the Munyon invention nor any other device is known which adapts a chimney extension member to a liner or tile having substantially different shapes or sizes.

SUMMARY OF THE INVENTION

The present invention overcomes this problem by providing a chimney tile adapter plate which permits a desired chimney extension member to be attached to chimney tile of varying sizes and shapes.

It is therefore a primary object of the present invention to provide a chimney tile adapter plate which includes a deflection plate, with flue opening, which rests upon the existing chimney tile; which includes a collar surrounding the opening and upwardly extending from the deflection plate for attachment of a desired chimney extension member; and which includes a flexible band in combination with an adjustable clamp for clamping the adapter plate to an existing chimney tile.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
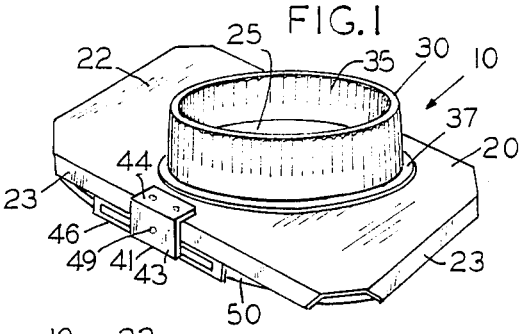
FIG. 1 is a top perspective view of one embodiment of the adapter plate of the present invention.
Figure 2:
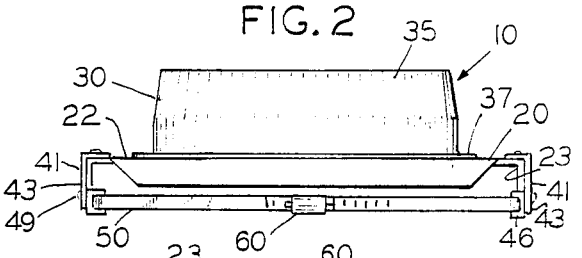
FIG. 2 is a side view of the adapter plate shown in FIG. 1.
Figure 3:
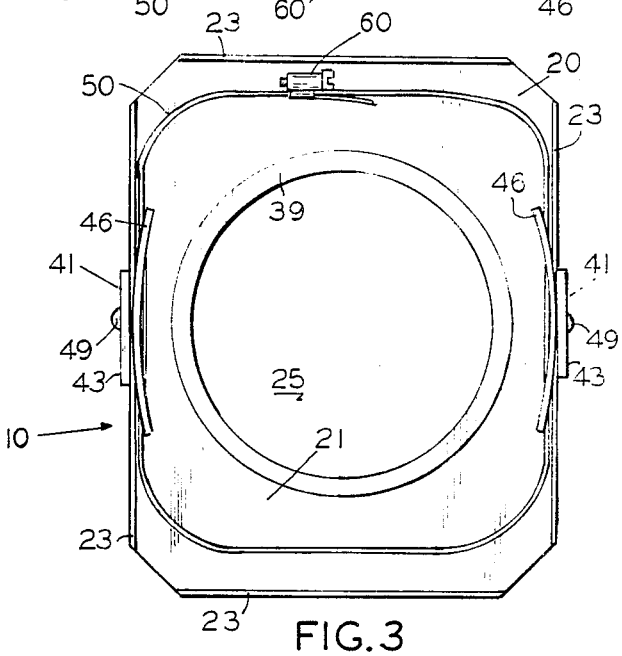
FIG. 3 is a bottom view of the adapter plate shown in FIG. 1.

Referring now to the drawings, and more particularly to FIGS. 1–3, an embodiment to be preferred of a chimney adapter plate 10, made according to the present invention is disclosed. Adapter plate 10 includes a deflector plate 20; a collar 30; bracket means; flexible band means 50; and adjustable clamp means 60.

Deflector plate 20, preferably made of sheet metal, includes a substantially planar upper surface 22 and a substantially planar under surface 21. The plate is provided with an opening 25 for the venting of flue gases. The plate also preferably includes downwardly bent lips 23 along each side and end of the plate to provide structural support.

Surrounding opening 25 and affixed to the deflector plate so as to extend above the upper surface of the deflector plate is a collar 30. The collar may be of any desired size and shape, being circular in configuration and having a diameter of eight inches in the embodiment shown. The collar may be provided with a multiplicity of fluted indentations 35 for convenient insertion into a chimney extension member such as a chimney cap, flue extension, spark arrester, and the like, not shown and not a part of this invention. The collar may be attached to the deflector by an conventional means. Collar flanges 37 and 39, shown in FIGS. 1 and 3, are used for attachment in the embodiment shown.

Figure 4:
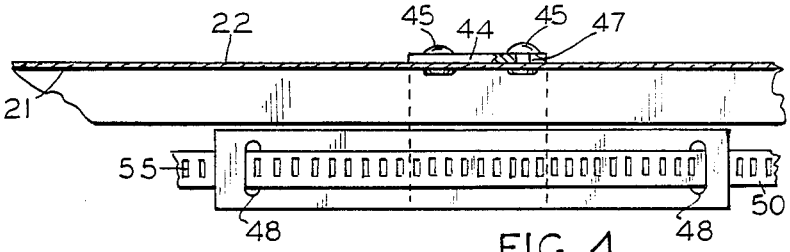
FIG. 4 is a side view of one of the brackets showing reception of the flexible band in the slots of the bracket.

Downwardly depending from deflector plate 20 is a pair of oppositely disposed flexible band retention brackets, designated by the numerals 41. Brackets 41, shown to advantage in FIGS. 1 and 4, each include an attachment member and a band support member 46. The attachment members are each provided with a vertical flange portion 43 and a transverse lip 44. Lip 44 is provided with rivet apertures 47 for receiving rivet 45 for attachment of the bracket to deflector plate 20. Each of the band support members 46 are attached by a rivet 49, or otherwise, to a respective flange 43 and include a pair of vertically extending, laterally spaced, slots 48 for slidably receiving band 50. It is obvious that any desired number of brackets may be employed.

Flexible band means 50 is preferably in the form of a single, elongated, flexible, metal band which is strung through each of the brackets, as above described, so as to be supported thereby and yet allowed lateral movement relative thereto. The band used in the present invention is well known in the hose clamping art and include, adjacent one end, a series of vertically extending, laterally spaced slots 55. While only one band 50 is used in the preferred embodiment, it is obvious that more than one band could be used to accomplish the same purpose.

Figure 6:
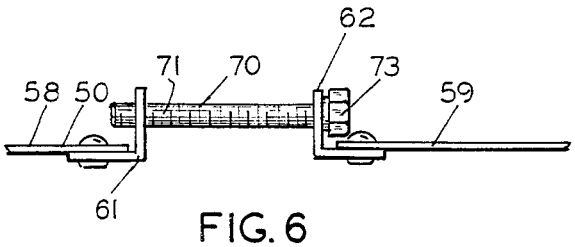
FIG. 6 is a side view of a second embodiment of the adjustable clamp of the present invention.
Figure 5:
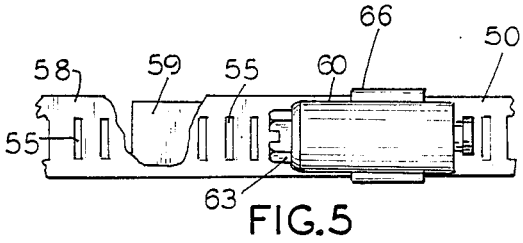
FIG. 5 is a plan view, in partial section, of one embodiment of the adjustable clamp of the invention.

Connecting the two ends of band 50 together is adjustable clamp means 60, preferably in the form as used and is well-known in the hose clamping art. A detailed description of the clamp is therefore believed unnecessary. The clamp is affixed to one end 59 of band 50 by housing 66, as shown in FIG. 5, and attaches to the other end 58 of the band by engagement of a threaded bolt 63 contained within the housing. The threads of the bolt engage slots 55 of the band to tighten or loosen the band upon rotation of the bolt. Another embodiment of clamp means 60 may be seen in FIG. 6. An L-shaped bracket 61, having a threaded aperture, is connected to end 58 of band 50 and a second L-shaped bracket, having an unthreaded aperture, is connected to opposing end 59 of the band. A machine screw 70 is connected to and between the brackets with threads 71 of the screw engaging the threaded aperture of bracket 61 and a rounded portion of the screw extending through the non-threaded aperture of bracket 62. Rotation of the head 73 of the screw causes tightening or loosening of the band about the chimney tile. Head 73 is provided with a smooth bearing surface for engagement with the bracket.

Figure 7:
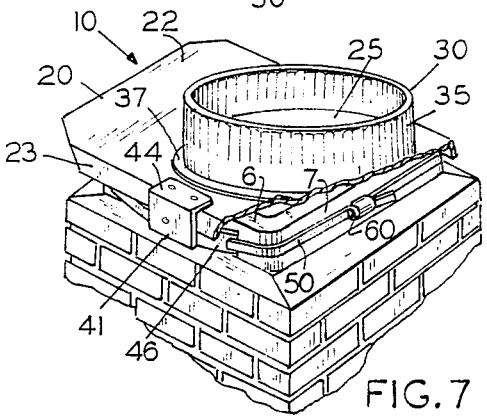
FIG. 7 is a perspective view, in partial section, of the adapter plate shown mounted on an existing chimney tile.

Referring now to FIG. 7, a description of use of the adapter plate will be provided. It is to be understood that the device may be used with either chimney tile or a chimney liner and therefore the word "tile" as used herein and in the appended claims is meant to include the word "liner". Adapter plate 10 is placed on chimney tile 7 with the planar undersurface 21 of the deflector plate horizontally oriented and engaging the top edge 6 of the tile. In this manner, all flue gases are deflected through opening 25 of the plate. Collar 30 is positioned over the flue defined by the chimney tile so that opening 25 is in alignment with the flue. Band 50 is caused to encircle tile 7 and bolt 63, assuming use of the adjustable clamp shown in FIG. 5, is rotated by a screw driver or wrench to tighten band 50 about the tile. During the tightening process, band 50 slidably engages brackets 41 by means of slots 48. It is to be appreciated that the shape or dimensions of the tile are immaterial in that band 50 is flexible and therefore conforms to the outermost periphery of the tile. Once the adapter plate 10 is secured to the tile, a chimney cap, flue extension, or other chimney extension member may be attached to the adapter plate by placement of the member over collar 30. Obviously, the portion of the extension member which engages the collar is to conform to the size and shape of the collar for a snug fit. In this manner, a standard extension member can be attached to varying sizes and shapes of chimney tile by means of the adapter plate 10 of the present invention.

Having thus described in detail a preferred selection of embodiments of the the present invention, it is to be appreciated and will be apparent to those skilled in the art that other physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A chimney tile adapter plate for connecting a chimney extension member to an existing chimney tile, said adapter plate comprising:

a horizontally oriented deflector plate defining an opening therethrough;

a collar surrounding said opening and affixed to and upwardly extending from said deflector plate for receiving the chimney extension member;

a flexible, elongated band positioned beneath and secured to said deflector plate, said band operable to encircle the chimney tile and be freely bendable to conform to the outer periphery of the chimney tile upon tightening; and adjustable clamp means for tightening said band to clamp said band to said tile.

2. The adapter plate as described in claim 1, wherein said deflector plate includes an undersurface having a horizontally planar portion for placement upon the uppermost terminal edge of the chimney tile.

3. The adapter plate as described in claim 1 wherein said collar includes a fluted upper portion for reception by the chimney extension member.

4. The adapter plate as described in claim 1 wherein said deflector plate includes at least two downwardly depending brackets for securing said band thereto.

5. The adapter plate as described in claim 4 wherein at least one of said brackets is provided with one or more slots for slidably receiving said band.

6. A chimney tile adapter plate for connecting a chimney extension member to an existing chimney tile, said adapter plate comprising:

a horizontally oriented deflector plate defining an opening therethrough, said deflector plate provided with a substantially planar undersurface for engaging the upper edge of the chimney tile to deflect flue gases through said opening;

a collar surrounding said opening, said collar affixed to and upwardly extending from said deflector plate for mounting of a chimney extension member thereon;

bracket means downwardly depending from said deflector plate;

flexible band means for encircling the chimney tile, said band means positioned beneath said deflector plate and supported by said bracket means and be freely bendable to conform to the outer periphery of the chimney tile upon tightening; and adjustable clamp means affixed to said band means for tightening said band means to clamp said band means to the chimney tile.

7. The tile adapter plate as described in claim 6 wherein said bracket means includes at least two brackets, each of said brackets provided with one or more slots for slidably receiving said band means.

* * * * *